United States Patent [19]

Pickerell et al.

[11] 3,952,897

[45] Apr. 27, 1976

[54] PRIMARY NURSER ASSEMBLY

[75] Inventors: Fred T. Pickerell, Spring City; Dominic J. Brignola, Phoenixville, both of Pa.

[73] Assignee: The West Company, Phoenixville, Pa.

[22] Filed: Apr. 29, 1974

[21] Appl. No.: 464,773

Related U.S. Application Data

[60] Continuation-in-part of Ser. No. 331,474, Feb. 12, 1973, abandoned, which is a division of Ser. No. 154,505, June 18, 1971, Pat. No. 3,779,413.

[52] U.S. Cl. ..... 215/11 C

[51] Int. Cl.[2] ..... A61J 9/00

[58] Field of Search ..... 215/11 R, 11 C; 128/252; 277/205, 206, 9.5, 178

[56] References Cited

UNITED STATES PATENTS

| | | | |
|---|---|---|---|
| 595,986 | 12/1897 | Worley | 215/11 R |
| 1,904,091 | 4/1933 | Shoop | 220/355 |
| 2,774,500 | 12/1956 | Budiani | 128/252 |
| 3,244,305 | 4/1966 | Moore | 215/11 C |
| 3,519,157 | 7/1970 | Meierhoefer | 215/11 C |
| 3,677,429 | 7/1972 | LaBarge | 215/11 R |

*Primary Examiner*—Donald F. Norton

*Attorney, Agent, or Firm*—Howson and Howson

[57] ABSTRACT

A primary nurser assembly for mounting over an opening in a container comprising a dam member including a lower wall spanning the opening in the container and a radially outwardly directed flange overlying the axial end face of the container adjacent the opening, said lower wall having a portion at least partially detachable to provide an access passage for discharge of the contents of the container, a nipple for mounting over the opening in the container having a stretchable lower base portion adapted to surround and overlie opposite faces of said flange, and means for seating said lower terminal edge portion of said nipple against the axial end face of said container to provide a seal therebetween.

3 Claims, 16 Drawing Figures

FIG. 1.
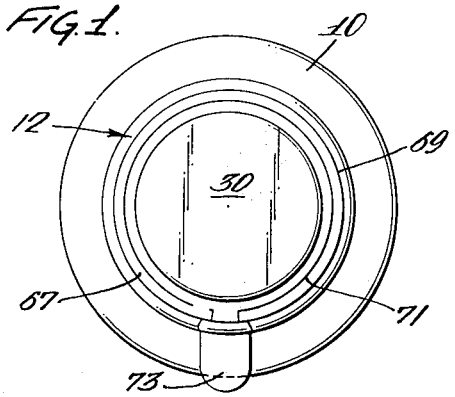
FIG. 2.
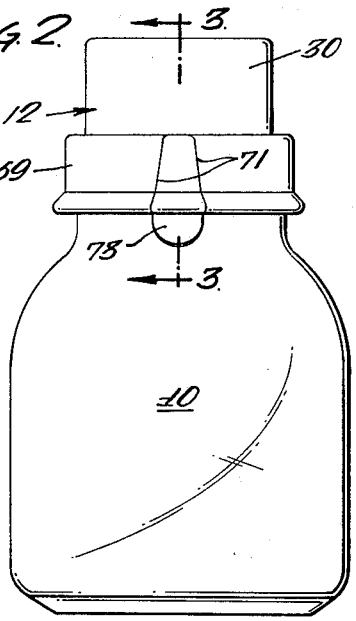
FIG. 3.
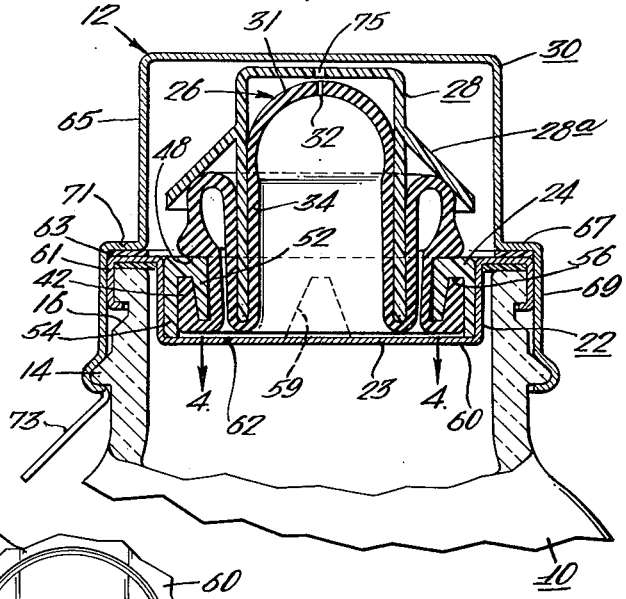
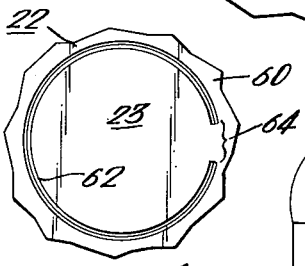
FIG. 4.
FIG. 5.
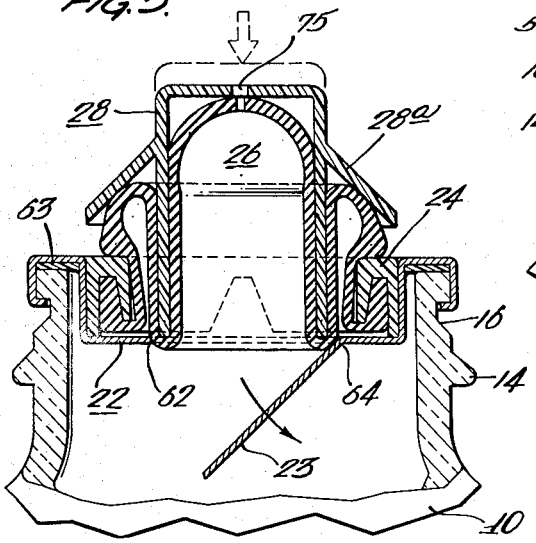
FIG. 6.
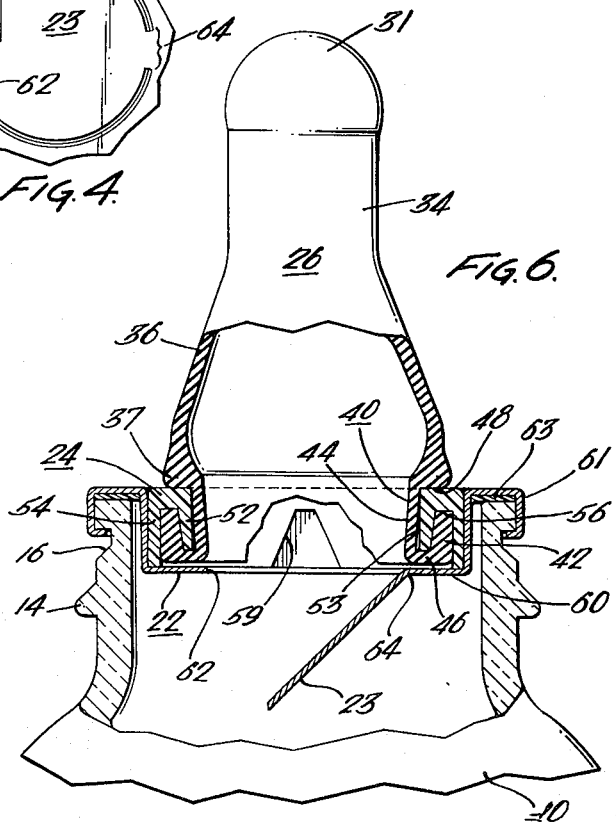

PRIMARY NURSER ASSEMBLY

This is a continuation in-part of our prior application, Ser. No. 331,474, "PRIMARY NURSER ASSEMBLY", filed Feb. 12, 1973, now abandoned which in turn is a division of our earlier application, Ser. No. 154,505, filed, June 18, 1971, which issued as U.S. Pat. No. 3,779,413 on Dec. 18, 1973.

The present invention relates generally to liquid food dispensing packages and more specifically to a package designed for infant feeding, referred to herein as a primary nurser.

Some of these conventional packages which are reusable generally comprise a container for the liquid product, for example milk formulae, a nipple and a retaining ring for holding the nipple over the open end of the container. The conventional reusable assemblies present the obvious problem of sterilization of the elements prior to each use which is tedious and time-consuming. The present invention relates to a disposable tamperproof sealed assembly which is adapted for hospital use as well as others. The assembly of the present invention is characterized by novel features of construction and arrangement providing a truly tamperproof assembly wherein the integrity of the liquid product prior to use and the sterility of nipple and surrounding surfaces are guaranteed.

The primary nurser assembly of the present invention includes a nipple sub-assembly adapted to be mounted over the open end of a container such as a bottle for the liquid product. The nipple sub-assembly includes a dam mounted in sealing relation over the open end of the container having a scored area defining a disk portion which may be actuated to an open position in a manner described hereafter when it is desired to withdraw the contents of the container. The nipple sub-assembly further includes a retainer mounted in the dam having locking means to which the nipple is secured, a pusher element mounted over the nipple, and an outer cover member detachably mounted over the nipple and pusher element including a tear band portion for removing the cover element when desired.

The primary nurser is truly tamperproof for the reason that the outer cover element maintaining the nipple and product sterile cannot be replaced without evidence of once having been opened and thus the integrity of the product and the sterile condition of the nipple are guaranteed prior to use. Further, in some forms of the invention the outer cover member is transparent so that if there is leakage of the liquid product past the dam, this can readily be determined. Leakage of product, of course, may result in chemical changes, for example, due to contact with the rubber nipple. Further, leakage of the liquid product past the seal is also evidence that the vacuum in the container may have been broken and thus the liquid product may not be fit for use.

The primary nurser assembly of the present invention is comprised of comparatively few parts which are easily and readily assembled and provide a very economical total assembly. Further, the assembly is easily and quickly manipulatable to a ready-to-use position. For example, the tear band is simply removed when it is desired to use the primary nurser to free the outer cover member and permit the user to actuate the pusher element downwardly without contacting the nipple to break the score line in the dam and actuate the disk downwardly to provide an opening in the dam through which the contents flow to the nipple. Thereafter, the user simply retracts the pusher element to elevate the nipple to a ready-to-use position and then discards the pusher element. The primary nurser is now ready for use. It is noted that during the entire preparation operation, the fingers of the user do not contact the sterile nipple, and thus the assembly is maintained in the desired aseptic condition for use in feeding, for example, an infant.

Even though the primary nurser assembly of the present invention is primarily used for infant feeding in hospitals, it is also obviously useful in feeding liquid or concentrated liquid nutrients to invalids, geriatric patients, animals and others requiring a nipple arrangement for liquid or concentrated liquid food intake.

These and other objects of the present invention and the various details of the operation and construction thereof are hereinafter more fully set forth with reference to the accompanying drawings wherein:

FIG. 1 is a plan view of a primary nurser assembly in accordance with the present invention;

FIG. 2 is a side elevational view of the assembly;

FIG. 3 is an enlarged sectional view showing the details of the nipple mounting arrangement taken on lines 3—3 of FIG. 2;

FIG. 4 is a fragmentary view of the dam separating the nipple and contents of the container as viewed on lines 4—4 of FIG. 3;

FIG. 5 is a view similar to FIG. 3 with the outer cap removed and showing the dam in an open position;

FIG. 6 is a view of the assembly in a ready-to-use position;

Figure 7:
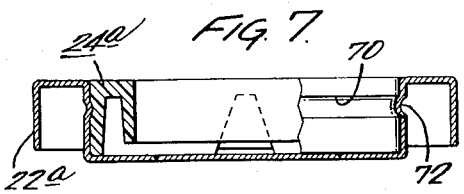
FIG. 7 is a sectional view showing an alternate means for securing the nipple retaining ring to the dam.

Referring now to the drawings and particularly to the embodiment of the invention illustrated in FIG. 1–6 inclusive, the primary nurser assembly includes a container 10, such as a bottle for a formula preparation for infants and a nipple assembly broadly designated by the numeral 12 mounted over the open end of the container 10. In the present instance, the container 10 has an annular radially outwardly projecting bead 14 spaced downwardly from the upper axial end face thereof and an annular channel 16 between the bead 14 and the axial end face. This construction facilitates mounting of the nipple assembly 12 in the manner described in more detail hereafter.

The basic elements of the nipple assembly comprise a dam 22 having a displaceable disk 23 normally sealing the open end of the container, a retainer 24 mounted in the dam 22, a nipple 26 mounted in the retainer 24, a pusher element 28 having a frusto-conical shield 28*a* overlying the nipple and operable to effect displacement of the disk 23 of the dam 22 to gain access to the contents when desired and operable to facilitate positioning of the nipple in a fully extended position as shown in FIG. 6 and an outer detachable cover member 30.

Considering now more speciifically the structural details and arrangement of the nipple assembly, the nipple 26 includes a spherical feeding tip 31 having at least one opening 32, a generally cylindrical section 34, a depending conical section 36 which terminates in a base 37 including locking portion 40. More specifically, the locking portion includes an upstanding rib 42 connected to a short cylindrical wall extension 44 of the base by a radial connecting wall 46. The locking rib 42 as shown underlies a radial shoulder 48 formed by the base 37 of the nipple. The wall 44 and locking rib 42 define a pocket for the retaining ring.

The retaining ring 24 as illustrated is an annular member comprising a pair of inner and outer depending walls 52 and 54 defining a channel 56 therebetween within which the locking rib 42 of the nipple is received. The inner wall 52 as illustrated is of a more shallow depth than the outer wall 54 and is chamfered at a predetermined angle to a plane of the inner face of the outer wall to facilitate assembly of the nipple. As illustrated in the assembled relation, the lower wall 48 of the base of the nipple presses firmly against the top of the retaining ring. The nipple is assembled to the retaining ring simply by placing the feeding tip 31 through the opening 53 defined by the inner wall 52 of the retaining ring and then pulling the nipple axially relative to the retainer whereby the locking rib 42 snaps in place in the manner shown in FIG. 6. It is noted that the locking arrangement is sufficiently stable to resist displacement of the nipple during normal case. The inner wall 52 of the retaining ring has a V-shaped cutout 59 to facilitate venting during use.

The retaining ring 24 as illustrated is mounted in the dam 22 and to this end the dam 22 is of an offset configuration defining a seat so that the retainer presses into the sidewall thereof. The dam has an outer flange arrangement 61 which is adapted to be crimped or spun over the upper end of the container and rolled into the channel 16 in the manner shown. As illustrated, the bottom wall 60 of the dam is scored or otherwise weakened, in the present instance, in a circular line 62, the ends of which are spaced apart to define a hinge connection 64. The central disc portion 23 defined by this scoring arrangement is adapted to be displaced downwardly in the manner shown in FIGS. 5 and 6 by fracturing the scoring when it is desired to use the assembly to feed an infant.

There is a seal 63 between the dam 24 and axial end face of the container 10 to maintain an internal vacuum or pressure in the container and to prevent possible ingress of bacteria into the container. This seal 63 may be a separate element or may be a flowed-in liner.

The outer cap 30 has a dome section 65 terminating in a radial wall 67 overlying the axial end face of the container and a skirt 69, the lower terminal edge of which is spun or crimped over the bead 14. The radial wall and skirt of the outer cap are scored as at 71 to permit removal and define a tear tab 73.

The pusher element 28 is of inverted cup-shaped form having a downwardly tapered conical shield 28*a* which overlies the folded portion of the nipple to prevent contact of the hand of the user with the nipple when manipulating the pusher element to break the dam 23 and also to raise the nipple to an extended position.

There is shown in FIG. 7 a modified form of the retaining ring and dam sub-assembly described above. As illustrated, the retaining ring 24*a* is provided with a circumferentially extending groove 70 in the outer face of the outer wall and the dam is provided with a circumferentially extending projection 72 positioned to engage in the groove 70 to more firmly secure the retaining ring in the dam. This is of particular importance to maintain the parts in the assembled relation and prevent leakage during the autoclaving or sterilization process.

Figure 8:
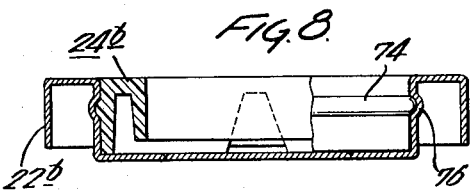
FIG. 8 is a view similar to FIG. 7 with still another alternate means for securing the nipple retaining ring to the dam.

FIG. 8 shows still another alternate means for firmly securing the retaining ring and dam sub-assembly. In this instance, the outer wall of the retaining ring is provided with a circumferentially extending bead 74 which seats in a circumferentially extending recess or groove 76 in the side wall of the dam. Of course, the groove and bead are located relative to one another so that the parts snap into place when the lower edge of the outer wall of the retainer abuts the bottom wall of the dam in the manner illustrated.

Figure 9:
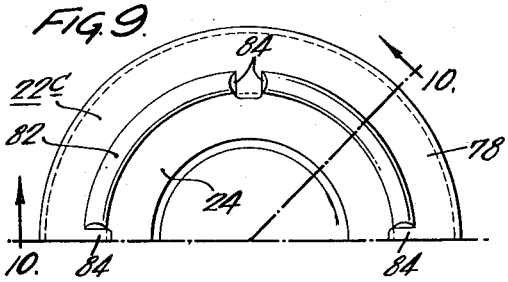
FIG. 9 is a fragmentary plan view of still further means for securing the nipple retaining ring to the dam.
Figure 10:
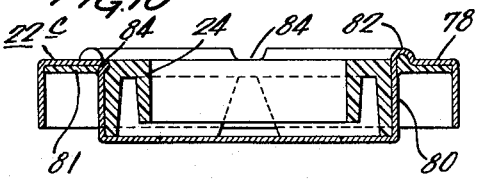
FIG. 10 is a sectional view taken on lines 10—10 of FIG. 9.

FIGS. 9 and 10 illustrate another alternative for firmly attaching the retaining ring 24 and dam 22*c*. In this instance, the juncture of the radial wall 78 and inner axial wall 80 of the dam is circumferentially ribbed as at 82 and the rib 82 is staked over the retaining ring at four equispaced locations as at 84. A flowed liner or gasket means 81 may be included as part of the sub-assembly.

Figure 11:
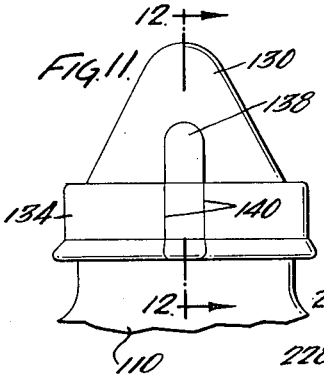
FIG. 11 is a fragmentary side elevational view of still another embodiment of primary nurser assembly in accordance with the present invention.
Figure 12:
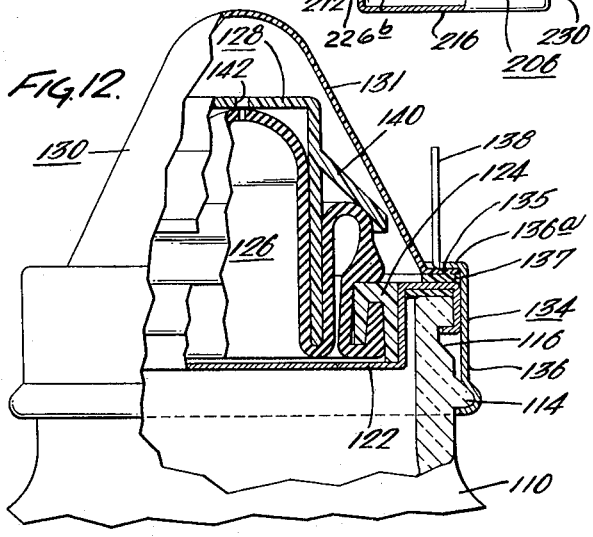
FIG. 12 is a sectional view taken on lines 12—12 of FIG. 11.

There is illustrated in FIGS. 11 and 12 another embodiment of primary nurser in accordance with the present invention. The container 110 is identical to the container described in connection with the previous embodiment and includes a radially outwardly directed bead 114 spaced downwardly from the open end and a recess or groove 116 adjacent the axial end face of the container.

In the present instance, the nipple assembly includes a dam 122, a retainer 124 mounted in the dam, a nipple 126 detachably secured to the retainer, and a pusher element 128 overlying the nipple and operable to effect displacement of the dam to gain access to the contents when desired and to facilitate the positioning of the nipple in a fully extended position. These elements are identical structurally to the corresponding elements in the previously described embodiment, and accordingly, are not described in greater detail here.

In the present embodiment the overcap assembly 130 includes a dome-shaped member 131 made of a transparent material, for example plastic, so that the assembly can be inspected for leakage as described more fully below. The dome member 131 is maintained in a position overlying the assembly in the manner shown by means of a tear band 134 which has an upper inwardly directed flange 136 overlying the terminal edge 135 of the dome and is adapted to be crimped or spun over the bead 114 on the container at its lower end to secure the parts in the manner illustrated.

A seal 137 is provided between the terminal edge of the dome and dam to prevent possible ingress of bacteria into the area enclosed by the dome which my contaminate the nipple. This seal 137 can be a separate element or it may be formed integrally with the dome or dam as a flowed-in liner. The tear band 134 has a tear tap extension 138 for the user when it is desired to pull the tear tab free and release the band 134. The tab 138 is formed by scoring the band in the areas indicated at 140. The band may be initially formed with only an upper flange 136a and then simply placed axially over the assembly and the flange 136 spun over the bead 114 to maintain the parts in the assembled relation shown. Now when it is desired to use the assembly, the tab 138 is simply pulled downwardly to completely disengage it from the band 134. The band 134 is then removed as well as the dome 130. The pusher is then actuated downwardly to break the dam as shown in FIG. 5 and then moved in the opposite direction to erect the nipple in a ready-to-use position. The pusher 128 has a shield 140 overlying the folded portion of the nipple to preclude contact of the hand of the user with the nipple. The top of the pusher has an opening 142 to facilitate gas sterilization of the nipple.

Figure 13:
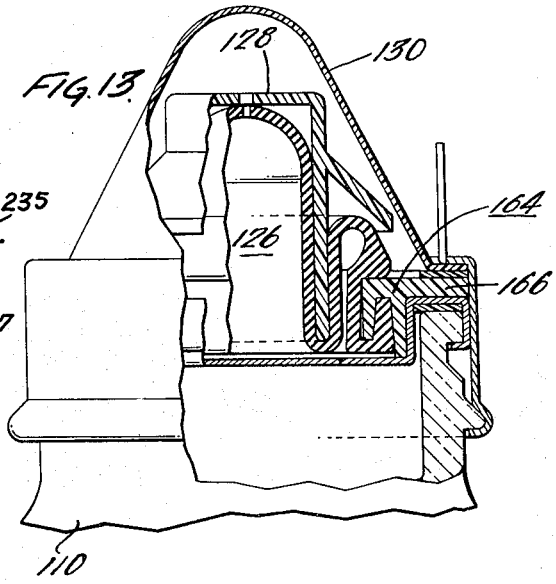
FIG. 13 is a view similar to FIG. 12 of a modified form of retaining ring.

The primary nurser shown in FIG. 13 is substantially identical to that of FIG. 12 except for the configuration of the retaining ring. In this instance, the retaining ring 164 has a radial outward wall extension 166 which acts as locking flange to insure against displacement relative to the dam during the autoclaving process.

Figure 15:
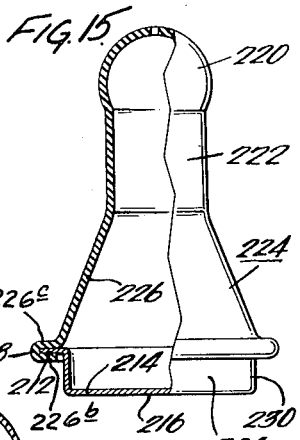
FIG. 15 is a partial sectional view of the nipple mounted on the dam.
Figure 14:
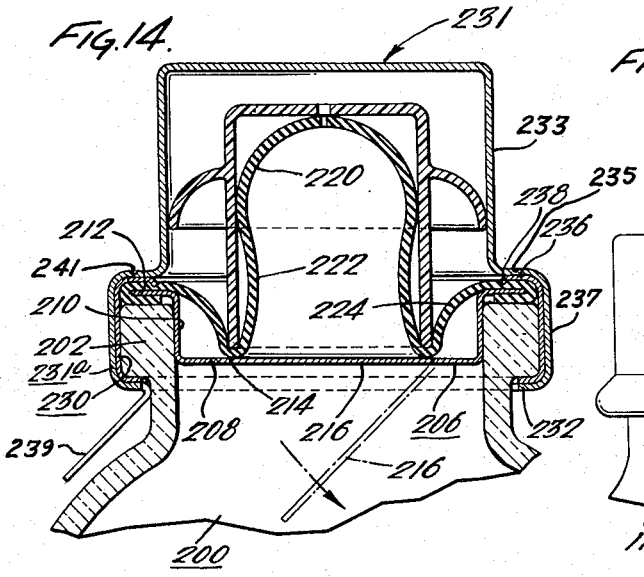
FIG. 14 is a sectional side elevational view of a third embodiment of primary nurser assembly in accordance with the present invention.

There is shown in FIGS. 14 and 15 still another form of primary nurser assembly in accordance with the present invention.

Figure 16:
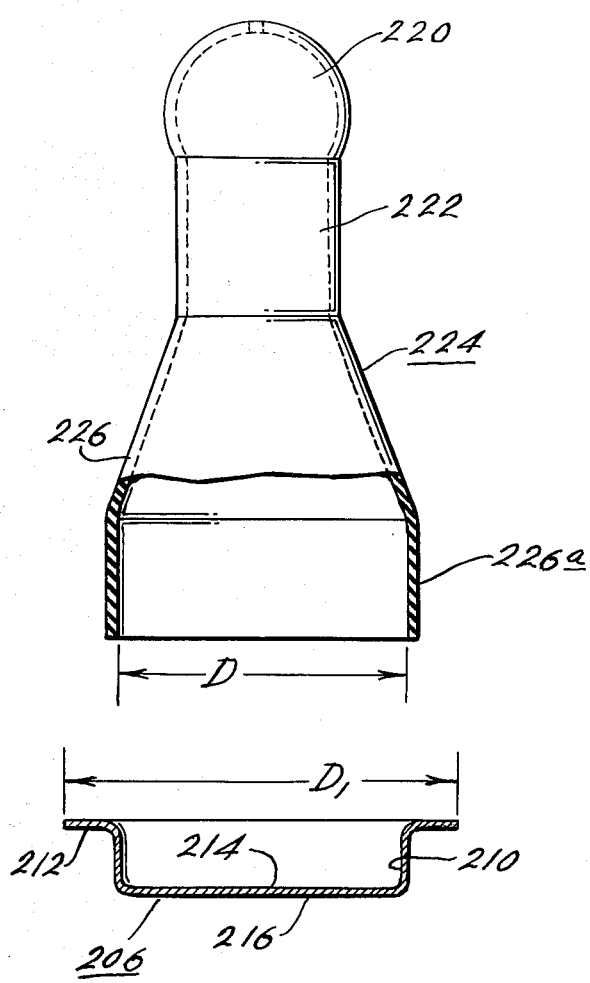
FIG. 16 is a side elevational view partly in section of the nipple and dam member prior to assembly.

The container 200 as illustrated has an enlarged bead 202 at its open end for mounting the nipple assembly. The nipple assembly includes, as illustrated, a dam 206 having a lower wall 208 spanning the opening in the container, a generally cylindrical side wall 210 and a radially outwardly directed flange 212. The lower wall is scored as at 214 to define a central disc portion 216 connected by means of a hinge in the same manner as the embodiments described above. The nipple as illustrated has a bulbous tip 221, a cylindrical body portion 222, a depending skirt portion 224 which has a frustoconical section 226, and a generally cylindrical base portion **226*a*. As illustrated in FIG. 16, the inner diameter D of the base portion 226*a* of the nipple in its relaxed state is less than the maximum diameter D1 of the flange 212. FOr example, the nipple diameter D may be between 0.700 to 0.784 inches and the outside diameter D1 of the flange 212 may be 1.125 inches. By this construction, when the dam is assembled in the base 226*a* of the nipple, the base is stretched and surrounds the flange 212 in the manner shown in FIG. 15. Accordingly, when the nipple is assembled to a container, by means, for example, of a retaining band 230 the lower turned-in portion 226*b* of the base portion of the nipple is pressed against the axial end face of the container to provide a seal therebetween. The portion of the base 226*c* overlying the flange 212 is engaged by the rolled-in edge of the retaining band 230 to provide a sealing action at this juncture. The nipple and dam are secured to the container in the position shown by means of a retaining band 230 which has a lower flange 232 crimped under the shoulder provided by the bead 202 and has an upward inwardly directed flange 236 with an inturned inner edge 238 which firmly imbeds itself in the nipple around the outer lip 212 of the dam. As illustrated, the outer cover member 231 has a dome-like top section 233 terminating in a radially outwardly directed wall portion 235 and a depending skirt 237 which overlies the retaining band 230 and is crimped at its lower end to retain it in place as illustrated, the outer cover member completely encapsulates the nipple and dam sub-assembly and protect the same against contamination prior to use. In this instance the outer cover member is simply positioned over the nipple and dam sub-assembly on the container so that the radial wall 231*b* overlies the base portion 226*c* of the nipple. A pressure is applied to the overcap to firmly seat the nipple against the axial end face of the container and then the lower terminal edge of the skirt 237 is rolled under the annular shoulder defined by the bead 202 of the container. The skirt 237 has a tear tab 239 connected by radial scoring (not shown) to a circumferentially extending score line 241 in the wall portion 235 to facilitate removal of the outer cover assembly in the same manner as that shown in the previously described embodiment of FIGS. 1–3** inclusive.

We claim:

1. The combination of a container having an access opening and a primary nurser for mounting over said access opening in said container comprising a dam member overlying the opening in said container and having an outer terminal annular edge portion confronting the surface of said container surrounding said opening therein, said dam member having a portion at least partially detachable to provide a discharge opening, a nipple made of a resilient, stretchable material having a generally cylindrical base portion of a diameter in its relaxed state less than the largest cross section of said dam member so that in assembly the base portion of said nipple overlies and underlies the outer terminal annular edge portion of said dam member and retaining means securing said nipple and dam to said container pressing said base portion underlying said annular edge portion of said dam member against the surface of said container surrounding said access opening to provide a seal therebetween and a pusher element disposed over the feeding tip of the nipple operative upon displacement toward said dam member to effect at least partial displacement of said portion to permit discharge of the contents of the container.

2. The combination as claimed in claim 1 wherein said container has an annular bead adjacent the opening therein defining a circumferentially extending shoulder exteriorly of the container and wherein said retaining means comprises a ring-like band overlying said bead and having a first inwardly directed flange overlying the nipple base portion and a second inwardly directed flange engaging under said shoulder on the container.

3. The combination as claimed in claim 2 including an over cap completely enclosing said nipple and dam member and which has a skirt portion overlying said retaining band.

* * * * *